United States Patent [19]

McSwain

[11] 4,328,927

[45] May 11, 1982

[54] TEMPERATURE RESPONSIVE VENTILATOR CONSTRUCTION

[76] Inventor: Edward D. McSwain, Rte. 3, Box 203, Lincolnton, N.C. 28092

[21] Appl. No.: 208,530

[22] Filed: Nov. 20, 1980

Related U.S. Application Data

[63] Continuation-in-part of Ser. No. 69,243, Aug. 23, 1979, Pat. No. 4,243,175.

[51] Int. Cl.[3] ..... F24F 13/08

[52] U.S. Cl. ..... 236/49; 98/32; 98/40 VT; 236/101 D; 267/156

[58] Field of Search ..... 98/32, 37, 40 VT, 41 R, 98/41 A V, 42 R, 102, 106; 206/505, 506; 236/49, 93 R, 101 D; 267/59, 156

[56] References Cited

U.S. PATENT DOCUMENTS

| | | | |
|---|---|---|---|
| 1,801,815 | 4/1931 | Livermore | 267/156 X |
| 2,975,975 | 3/1961 | Weber | 236/49 |
| 3,436,016 | 4/1969 | Edwards | 236/49 |
| 3,480,178 | 11/1969 | Morgan | 206/506 |
| 3,528,606 | 9/1970 | Witten | 236/49 X |
| 3,852,514 | 12/1974 | Lauben | 220/3.8 X |
| 4,175,480 | 11/1979 | Beam, Jr. et al. | 236/49 X |
| 4,210,279 | 7/1980 | McSwain | 236/49 |

*Primary Examiner*—William E. Wayner
*Assistant Examiner*—Harold Joyce
*Attorney, Agent, or Firm*—Luke J. Wilburn, Jr.; Wellington M. Manning, Jr.

[57] ABSTRACT

An improved temperature-responsive wall ventilator construction comprising a housing having side walls defining an air flow passageway, a plurality of louvers disposed in said passageway and operatively attached to opposed side walls of the housing for pivotal movement to control the flow of air through the passageway. A temperature-responsive bimetallic coil spring located in the passageway and in an opening through one of the louvers controls pivotal movement of the louvers in the passageway to regulate the flow of air therethrough. One end of the coil spring is mounted directly to a face of one of the louvers, and the other end portion of the coil spring extends into an opening in a side wall of the housing to serve as sole pivotal support for one end of the louver. Temperature changes cause expansion and contraction of the spring which causes corresponding pivotal movement of the louver. The wall opening which supports the end of the spring is peripherally notched to permit adjustment of the spring tension to open or close the louvers at a desired air temperature.

The ventilator housing includes an integrally formed front peripheral flange and protective grill with screen member which spans the air flow passageway, and the rear of the housing passageway is enclosed by a removable grill frame with screen to further protect the louvers and temperature-responsive spring from contact with foreign objects.

5 Claims, 4 Drawing Figures

TEMPERATURE RESPONSIVE VENTILATOR CONSTRUCTION

This application is a continuation-in-part of my copending allowed U.S. patent application Ser. No. 69,243 filed Aug. 23, 1979 now U.S. Pat. No. 4,243,175.

The present invention relates to a ventilator construction for use in wall openings to provide ventilation of spaces, and, more particularly, to an improved temperature-responsive ventilator construction wherein louvers of the ventilator are automatically moved in response to temperature changes to control air flow through the ventilator.

BACKGROUND OF THE INVENTION

It is known to provide wall ventilator constructions with closure louvers or shutters associated with a temperature-responsive spring which operates to move the louvers and control flow of air through the ventilator. U.S. Pat. Nos. 3,436,061 and 3,528,606 disclose temperature-responsive foundation wall ventilators comprising a housing defining an air flow passageway containing a plurality of parallel, side-by-side louvers pivotally mounted for simultaneous movement to open and close the passageway, and operatively connected to a bimetallic temperature-responsive coil spring which expands or contracts in response to temperature changes to simultaneously pivot the louvers between open and closed positions. In U.S. Pat. No. 3,436,016, the coil spring is located in the air flow passageway of the ventilator in a central opening in one of the louvers, with the inner end of the coil spring attached to a stationary support rod for the louver, and the outer end attached directly to the face of the louver. The louvers are operatively interconnected and are pivotally moved by temperature changes which cause expansion or contraction of the spring. In U.S. Pat. No. 3,528,606, the coil spring is located in an enclosed box on one side of the ventilator air flow passageway, with the inner end of the spring being fixed to the ventilator housing by a bolt, and the outer end of the spring being operatively attached to a member which interconnects the louvers for simultaneous movement.

U.S. Pat. No. 4,175,480 discloses a wall ventilator construction having a temperature-responsive spring located in the housing air flow passageway in a central opening of one of the louvers. The spring is operatively attached to a stationary rod and to the face of the louver to simultaneously rotate the louvers in response to temperature changes. The ventilator has a flanged front frame attached by pins to the housing to overlie the periphery of a foundation wall opening, and the patent discloses that the ventilator housing may be formed of molded plastic.

My U.S. Pat. No. 4,210,279 discloses an automatic temperature-responsive ventilator wherein the temperature-responsive spring is located in a side wall opening of the ventilator housing within a retainer-protector cap secured in the opening. One end of the spring resides in a slot in the periphery of the wall opening and the other end of the spring is received in a slotted rod which extends into an opening in one of the louvers of the ventilator to move the louvers in response to contraction and expansion of the spring.

My aforesaid copending U.S. patent application Ser. No. 69,243 filed Aug. 23, 1979, now U.S. Pat. No. 4,243,175, the disclosure of which is incorporated herein by reference, discloses a temperature-responsive ventilator construction comprising a housing of molded plastic defining an air flow passageway containing a plurality of movable louvers which are interconnected for simultaneous pivotal movement to control the flow of air through the passageway. Operation of the louvers is controlled by a temperature-responsive elongate, helical spring, one end of which is attached directly to the face of one of the louvers and the other end of which is slidingly received on a stub shaft which is received within an opening in a side wall of the housing. The periphery of the side wall opening and the peripheral surface of the stub shaft are of notched configuration. Tension on the spring may be adjusted manually by rotation of the stub shaft in the side wall opening, so that the ventilator louvers may be initially set to open and/or close at a desired air temperature.

OBJECTS OF THE PRESENT INVENTION

It is an object of the present invention to provide a modified temperature-responsive ventilator construction of the general type described in the aforementioned patents and in my said copending application.

It is another object to provide a temperature-responsive wall ventilator construction wherein louvers of the ventilator are controlled by a temperature-responsive coil spring, and wherein the operative attachment of the control spring with the louvers and ventilator housing is of simplified and more economical construction.

It is a further object to provide an improved temperature responsive ventilator construction wherein the ventilator housing is of unitary construction, and wherein the temperature responsive control spring for moving the louvers of the ventilator is located in the air flow passageway of the ventilator and provides direct pivotal support and connection of an end of one of the louvers to the ventilator housing.

SUMMARY OF THE INVENTION

Briefly, the present invention comprises a temperature responsive ventilator construction for use in wall openings, such as foundation walls of buildings, wherein the ventilator comprises a housing defining an air flow passageway having a plurality of louvers disposed therein and interconnected for pivotal movement to control the air flow through the passageway. The louvers are moved in response to temperature changes by the provision of a bimetallic coil spring which is mounted in the air flow passageway within an opening through one of the louvers. The outer end of the spring is attached directly to the face of the louver and the inner end portion of the spring is bent to extend outwardly from the coil and into an opening in the side wall of the housing to form an end support for pivotal movement of the louver to which the spring is attached.

The periphery of the side wall opening is notched to directly receive the end portion of the coil spring in a selected one of several positions therein to permit adjustment of the spring and to prevent rotation of the end portion of the spring during expansion and contraction of the same.

The ventilator housing is preferably of unitary molded plastic construction and includes a front peripheral flange which overlies the peripheral face of a wall opening into which the ventilator is inserted. The housing further includes an integral protective grill disposed across the air flow passageway and recessed in the passageway behind the front flange to facilitate nested stacking of a plurality of such ventilator constructions for storage and shipment. An additional removable grill frame may be provided for closing the rear of the housing passageway to further protect the louvers and temperature responsive spring from contact with foreign objects.

DETAILED DESCRIPTION OF THE INVENTION

Figure 1:
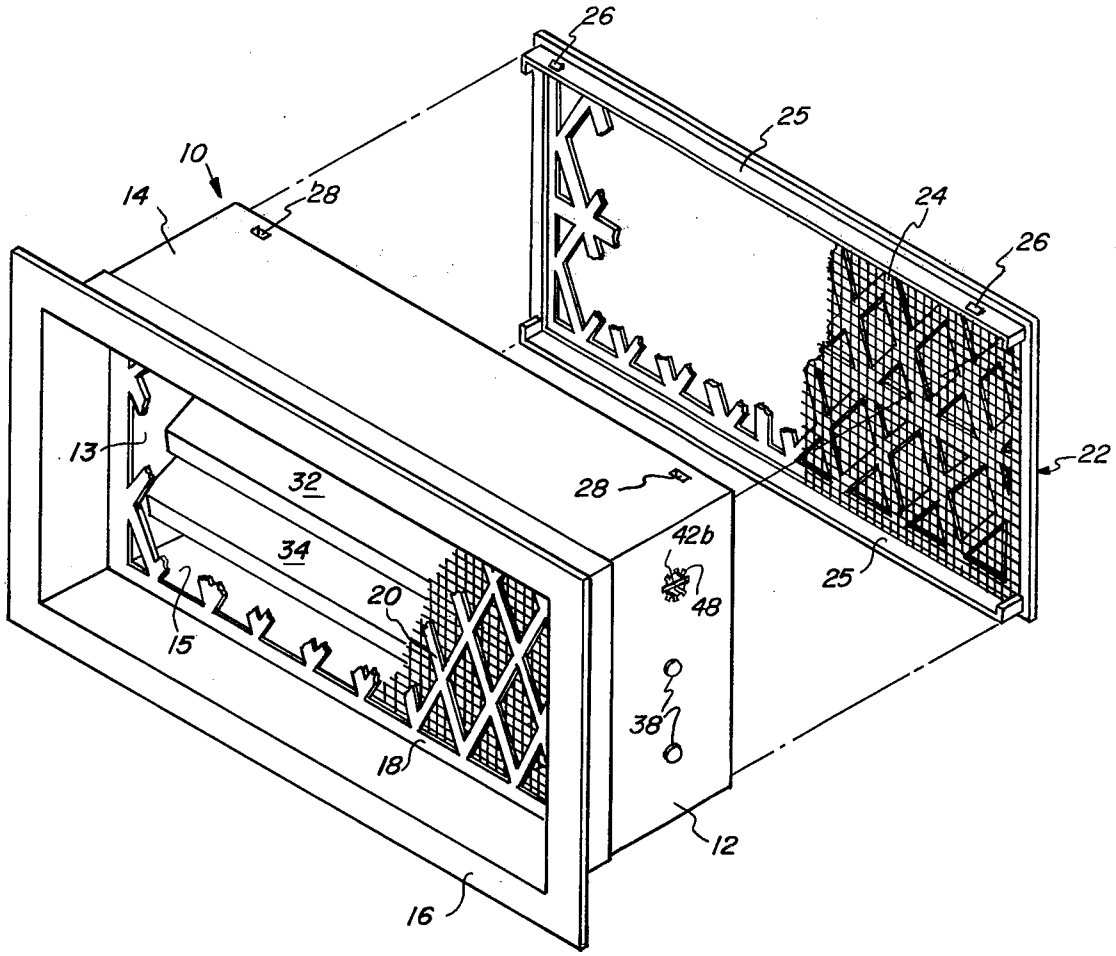
FIG. 1 is a front perspective view of the ventilator construction of the present invention with the rear grill frame of the ventilator shown in exploded position.

Referring more specifically to the drawings, FIG. 1 is a front perspective view of the ventilator construction of the present invention. The ventilator comprises a housing 10 having spaced opposed pairs of side walls 12, 13 and 14, 15, respectively, which define a generally rectangular air flow passageway through the housing. Preferably, the ventilator housing 10 is of unitary molded plastic construction of suitable strength, such as polyethylene, and includes a unitarily molded front peripheral flange 16, and a unitarily molded grill or lattice 18 which spans the passageway in spaced relation behind the front flanged end thereof. Peripheral flange 16 extends perpendicular to the housing side walls to overlie the periphery of a wall opening into which the ventilator is inserted for use.

Located behind and in contiguous relation with grill 18 is a suitable screen, such as a screen wire 20, which protects the ventilator from passage of foreign objects and materials therethrough. Wire screen 20 is supportably attached to the grill, as by spot heat-melting of the plastic grill about the wire screen. The rear of the housing passageway is provided with a second molded plastic grill frame 22 with wire screen element 24. Frame 22 has upper and lower flange portions 25 provided with resilient finger elements 26 which frictionally engage openings 28 in the housing walls to provide for snap fit securement and removal of the grill frame from the housing.

Figure 2:
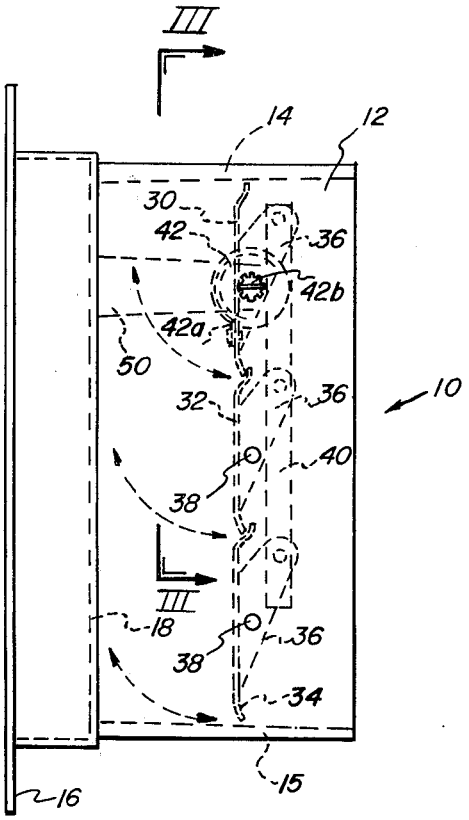
FIG. 2 is a right side elevation view of the ventilator of FIG. 1.

As best seen in FIG. 2, located in the housing passageway behind grill 18 are louver means, shown as three louvers 30, 32, 34, which are disposed in parallel side-by-side relationship and are supported on housing side walls 12, 13 for pivotal movement to control flow of air through the passageway. The ends of each of the louvers 30, 32, 34 have right angle leg portions 36 for attachment of the louvers to side walls of the housing. Leg portions of the lower two louvers 32, 34 are pivotally attached by pins or rivets 38 to the respective side walls 12, 13 of the housing and the leg portions at the right hand end of all three louvers are pivotally interconnected by a connecting bar 40 to permit simultaneous pivotal movement of the louvers about their attachments to the side walls. The leg portion at the left end of upper louver 30 is pivotally connected by a rivet to the adjacent housing side wall 13, and the right end of louver 30 is supportably connected to the opposite side wall 12 by a temperature-responsive, bimetallic coil spring 42, as will be explained.

Figure 3:
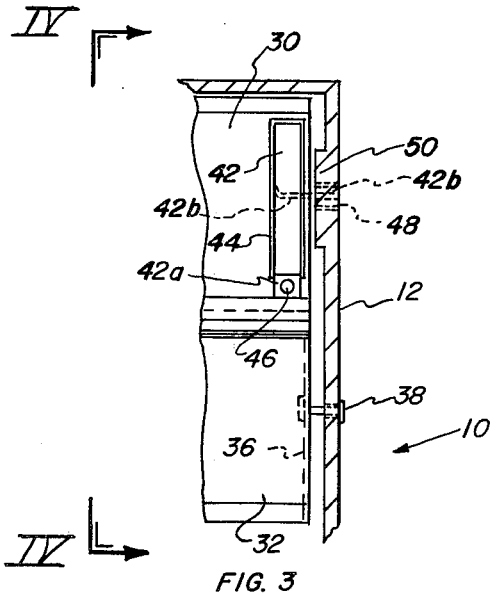
FIG. 3 is an enlarged broken away sectional elevation view of the right side wall portion of the ventilator, taken generally along line III—III of FIG. 2.
Figure 4:
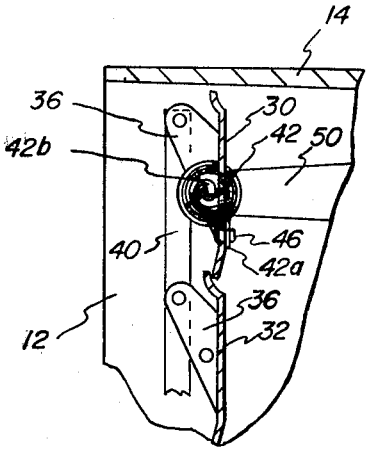
FIG. 4 is a broken away sectional elevation view of the right rear portion of the ventilator looking in the direction of arrows IV—IV of FIG. 3, and further illustrating the mounting and arrangement of the temperature responsive coil spring of the ventilator.

As best seen in FIGS. 2–4, the right end portion of the upper louver 30 is provided with a generally rectangular opening 44 (FIG. 3) in which the temperature-responsive coil spring 42 is disposed. The outer end **42*a* of coil spring 42 is bent and fixedly secured directly to the face of louver 30 by suitable means, such as a rivet 46. The flat inner end portion 42*b* of spring 42 is bent to extend outwardly along a central axis of the coil, through a circular opening in the louver leg portion 36, and into an opening 48 (FIGS. 1 and 3) in the side wall 12 of the housing. The periphery of housing side wall opening 48 is provided with spaced opposed pairs of notches such that the flat end portion 42*b* of the spring 42 may be selectively received in one of a number of arcuately spaced positions about the axis of opening 48 to prevent rotation of the end portion of the spring during expansion and contraction of the spring. In initial assembly of the ventilator, the end portion 42*b*** of the spring may thus be rotated about the coil axis and inserted in a selected pair of wall opening notches to set tension on the spring to open or close the louvers at a selected air temperature.

Thus, it can be seen that the temperature responsive spring 42 arrangement of the ventilator of the present invention not only serves to simultaneously move the louvers 30, 32, 34 in response to temperature change to control the flow of air through the passageway, but also serves to directly pivotally support the end portion of the upper louver 30 in the housing side wall 12 without the need of additional shafts or connecting rods for such purpose.

Louvers 30–34 may be manufactured of suitable lightweight material, such as aluminum or plastic.

As best seen in FIG. 2, side wall portions of the housing between the passageway grill 18 and the front flange 16 of the ventilator define an enlarged cross sectional area of the housing air flow passageway which can receive the rear end portion of another ventilator housing in nested relation therewith to facilitate stacking of a plurality of ventilators for storage and shipment. As also seen in FIGS. 2 and 3, the portion 50 of housing side wall 12 surrounding side wall opening 48 is of increased thickness to positively support and secure the flat end portion **42*b* of spring 42** against rotational movment during expansion and contraction of the spring coil to move the louvers.

From the foregoing description, it can be seen that the improved ventilator construction of the present invention provides reliable automatic temperature responsive control of air flow therethrough with minimal use and assembly of separate parts thereof in a manufacturing operation, and with corresponding reduced expense of manufacture.

That which is claimed is:

1. A temperature-responsive ventilator construction comprising a housing defining an air flow passageway therethrough, a plurality of louvers mounted in said housing passageway and operatively interconnected for simultaneous pivotal movement in said passageway to control the flow of air therethrough, a temperature-responsive bimetallic coil spring located in said passageway, one end of said spring attached to an end portion of one of said louvers and the other end supportably received within a wall opening of said housing and engageable with said wall to pivotally support said end portion of said one louver and to move said louvers in response to temperature changes, and wherein said housing wall opening has a notched peripheral configuration to selectively receive said other end of the spring in one of a number of arcuately spaced positions therein and to prevent its rotation in the opening during expansion and contraction of the spring.

2. A ventilator construction as defined in claim 1, wherein said end portion of said one louver has an opening therethrough, said coil spring is disposed in said opening, and said one end of the spring is the outer end of the coil spring attached to the face of the louver.

3. A ventilator construction as defined in claim 2 wherein said other end of the coil spring is an inner end portion of the coil which is bent to extend generally along the central axis of the coil and into said housing wall opening.

4. A temperature-responsive ventilator construction comprising a housing having spaced side walls defining an air flow passageway therethrough, a plurality of louvers disposed in said passageway in generally parallel side-by-side relation, means interconnecting and mounting said louvers in said passageway for simultaneous pivotal movement to control air flow through the passageway, said mounting means including a temperature-responsive spring of coiled configuration disposed in said passageway and having one end fixedly attached to one of said louvers and the other end portion bent to lie along the axis of pivotal movement of said one louver and extend through and directly engage a side wall opening of said housing to support said one louver for pivotal movement and to impart pivotal movement to said louvers in response to temperature changes, and said side wall opening having a notched periphery to permit the selective positioning and securement of said other end portion of said spring in the opening to prevent its rotation during expansion and contraction of the spring.

5. A temperature-responsive ventilator construction as defined in claim 4 wherein the coil portion of said spring is disposed within an opening through said one louver with the outer end of the coil spring fixedly attached to the face of said one louver, and with the inner end portion of the coil spring being bent to extend from the end of said one louver and into said side wall opening.

* * * * *